US008841607B2

(12) United States Patent
Yang et al.

(10) Patent No.: US 8,841,607 B2
(45) Date of Patent: Sep. 23, 2014

(54) ATMOSPHERIC PRESSURE ION SOURCE WITH EXHAUST SYSTEM

(75) Inventors: Zicheng Yang, Alameda, CA (US); Roy P Moeller, San Leandro, CA (US); Stephen Zanon, Campbell, CA (US)

(73) Assignee: Bruker Daltonics, Inc., Billerica, MA (US)

( * ) Notice: Subject to any disclaimer, the term of this patent is extended or adjusted under 35 U.S.C. 154(b) by 55 days.

(21) Appl. No.: 13/602,249

(22) Filed: Sep. 3, 2012

(65) Prior Publication Data

US 2014/0061500 A1 Mar. 6, 2014

(51) Int. Cl.
*H01J 49/26* (2006.01)

(52) U.S. Cl.
USPC ..... 250/282; 250/288

(58) Field of Classification Search
USPC ..... 250/288, 282, 287
See application file for complete search history.

(56) References Cited

U.S. PATENT DOCUMENTS 3,875,068 A * 4/1975 Mitzel ..... 422/186.05
7,145,138 B1 * 12/2006 Thakur ..... 250/288
7,465,920 B2 * 12/2008 Hiraoka ..... 250/288
8,058,611 B2 * 11/2011 Wouters et al. ..... 250/288
2011/0068263 A1 * 3/2011 Wouters et al. ..... 250/282

OTHER PUBLICATIONS

Robb, D. B., Covey, T.R. and Bruins, A. P., "Atmospheric Pressure Photoionization: An Ionization Method for Liquid Chromatography-Mass Spectrometry", Analytical Chemistry, v. 72, pp. 3653-3659 (2000).

Banerjee, S. and Mazumdar, S., "Electrospray Ionization Mass Spectrometry: A Technique to Access the Information beyond the Molecular Weight of the Analyte", International Journal of Analytical Chemistry vol. 2012, Article ID 282574, pp. 1-40.

* cited by examiner

*Primary Examiner* — Nikita Wells
*Assistant Examiner* — Johnnie L Smith
(74) *Attorney, Agent, or Firm* — ROBIC, LLP

(57) ABSTRACT

An atmospheric pressure ion source, employing the principle of electrospray ionization, chemical ionization, or photo-ionization, comprises a spray probe for spraying a liquid into an ionization chamber and has an exhaust port through which residual spray mist and waste gas, such as evaporated solvent, are extracted. The ion source further comprises an exhaust system comprising a conduit which is connected to the exhaust port. The conduit has a transition from a first cross-section to a second cross section at a point downstream of the exhaust port wherein the second cross section is reduced in relation to the first cross section. Gas is injected via a gas injector into the conduit in a region of the transition to create a low pressure region that removes unwanted material from the chamber.

19 Claims, 3 Drawing Sheets

ATMOSPHERIC PRESSURE ION SOURCE WITH EXHAUST SYSTEM

BACKGROUND

The invention relates generally to atmospheric pressure ion sources, such as electrospray ion sources (ESI), chemical ionization ion sources (APCI) and photo-ionization ion sources (APPI), having novel exhaust systems. Some applications require ionization of analytes that are contained in a liquid carrier medium, such as solvent. In a liquid chromatography—mass spectrometry (LC/MS) interface, for example, the eluent from an LC column is introduced into an ionization chamber that is maintained at, or close to, atmospheric pressure. Basically, the three above-indicated ionization mechanisms have found wide-spread application with atmospheric pressure ion sources.

The eluent can be ionized by electrospray where a high voltage difference, such as ranging from one to eight kilovolts, is generated between a conduit delivering the liquid eluent and an appropriate counter-electrode in order that charged droplets are generated. A nebulizer gas can be used in order to shear the droplets and further reduce their size (pneumatically-assisted electrospray). Still other desolvation or drying gases can be added with temperature above ambient, such as several hundred degrees centigrade, in order to promote solvent evaporation. Details of the ESI technique have been discussed in the literature; see, for instance, a recent review article by S. Banerjee and S. Mazumdar "Electrospray Ionization Mass Spectrometry: A Technique to Access the Information beyond the Molecular Weight of the Analyte", International Journal of Analytical Chemistry, Volume 2012, Article ID 282574, 40 pages, doi:10.1155/2012/282574.

In an APCI ion source the eluent from the LC is introduced and nebulized in a heater zone in order to vaporize the liquid. The eluent in the gas phase is ionized via primary and secondary charge transfer reactions with reagent ions originating from a reagent ion source gas that is ionized by a corona discharge. A variety of means, such as introducing a heated gas, can be used to transfer the energy necessary for vaporization as is known in the art.

Instead of charge transfer reactions, photons may be used for ionizing the sprayed and vaporized eluent in a photo-ionization process. APPI has been described, for example, in an early report by Robb et al., Analytical Chemistry, Vol. 72, No. 15, Aug. 1, 2000 3653-3659.

A portion of the ionized eluent in the form of gas-phase ions and tiny charged droplets is sampled into the inlet of the mass spectrometer while the remains of the spray droplets and the gases assisting in the spraying and evaporation need to be removed from the source housing to avoid recirculation and possible memory effect responses from the mass spectrometer. The exhaust port typically is an opening at the bottom of the source housing, which allows evacuation of unevaporated droplets, residual spray mist, solvent vapor and gas from the source chamber. Usually such a port is located opposite to the spray probe that delivers the liquid eluent and has a cross section area that generally matches the dimensions of the spray cone at its entrance, preferably with a slight oversize. The exhaust port is connected to an exhaust tube which further carries away the waste out of the ion source chamber. Ideally, such a tube is co-axial with a general spray direction and should extend to an infinite length without any change in direction to establish the most favorable flow conditions and to be most effective in avoiding a back flash flow that returns to the ion source chamber. In reality, for practical reasons, however, the exhaust tube needs to be bent at some point to change the exhaust flow direction.

U.S. Pat. No. 7,145,138 B1 to Thakur teaches that a change in flow direction in the exhaust tube can be used to prevent back flash of liquid into the source. However, practice shows that the results achievable with this design are not quite satisfactory.

US application 2011/0068263 A1 to Wouters et al. presents an ion source where a tip of the spray probe is located in a continuous flow guide. In the spray direction, a cross-sectional area that defines a first portion of an internal volume of the flow guide initially decreases in a convergent-like manner and thereafter increases in a divergent-like manner towards an exit opening of the source housing. The aim is to provide for unidirectional flow past a sampling orifice of a mass spectrometer inlet to prevent recirculation of waste gas and solvent. Such a design requires significant modification of the source housing design and is therefore generally not desired.

U.S. Pat. No. 6,614,017 B2 to Waki teaches a droplet or liquid collector in a forward spray direction as to avoid bouncing back of droplets into an ion sampling region. This teaching may be adequate for liquid droplets but largely fails to address the adverse effects of excess gas-phase solvent recirculating in the source housing, for example.

U.S. Pat. No. 6,459,081 B2 to Kato presents an API mass spectrometer that is supposed to prevent effects of nonvolatile salts on the mass analysis without deteriorating the vacuum condition of the mass analysis portion. Essentially, crystals of nonvolatile salts precipitated on certain surfaces in a spray chamber are washed away with a washing solution, such as water.

Hence, there is still a need for an exhaust system to be operated with an atmospheric pressure ionization source that reduces the risk of residual spray mist and waste gas recirculation in an ionization chamber.

SUMMARY

In accordance with the principles of the invention, an atmospheric pressure ion source comprises a spray probe for spraying a liquid into an ionization chamber, the ionization chamber having an exhaust port through which residual fluid is extracted. The source also has an exhaust system comprising a tubing which is connected to the exhaust port, the tubing having a transition from a first cross-section to a second cross section at a point downstream of the exhaust port, the second cross section being reduced in relation to the first cross section. The exhaust system further comprises a gas injector through which a gas can be injected into the tubing in a region of the transition.

Primarily, the pressure differential for extracting residual fluid, such as comprising waste gas, solvent vapor and residual spray mist, from the ionization chamber is generated by means of the gas injection. The set-up of the gas injector and its surroundings forms a particularly efficient vacuum source. The pressure conditions in the region of cross section transition are, furthermore, favorable as they provide increased aspiration forces in this region and allow any residual fluid present in this area to be more thoroughly extracted than with aspiration forces created by standard vacuum sources. The transition in cross section can be smooth, for instance by using a conical tube segment. Generally, such conical tube design may have linear, convex (trumpet-shape), or concave (tulip-shape) tube walls. However, in other embodiments the transition can also be stepwise as long as the steps are small enough as not to cause too much undesired turbulence in the gas flow pattern.

Generally, the exhaust port is the only sink for gas and droplets in an ionization chamber whereas sources thereof may comprise nebulizer gas conduits, desolvation gas conduits, drying gas conduits, liquid conduits in the spray probe (which also contribute to the gas balance by evaporated liquid/droplets), and as the case may be, ambient air to maintain a constant pressure level in the ionization chamber even when no liquid is sprayed into the chamber, for instance. It is well understood by one of ordinary skill in the art that the mass flows into and out of the ionization chamber generally have to be balanced such that no back pressure builds up which could promote undesired recirculation.

In various embodiments, the tubing comprises a bend, and the transition is located downstream of, and proximate to, the bend. The tubing walls around the bend can be rounded in order to allow for a smooth change in flow direction.

In further embodiments, the tubing has a first segment upstream of the bend and a second segment downstream of the bend, and an angle between the first segment and the second segment ranges generally from 90° to 180°. Such design accounts for spatial restrictions in the lab with which an operator of the ionization source is frequently confronted.

In various embodiments, the exhaust port is located and configured such as to receive a spray cone, preferably the complete spray cone, emanating from the spray probe.

In some embodiments, an axis of the exhaust port and an initial axis of the tubing coincide with an axis of the spray probe so that a spray cone emanating from the spray probe is generally centered on the joint axis. However, in other embodiments the axes can also be slightly inclined towards each other, and/or can be slightly offset from one another. In still other embodiments, it may be difficult to define an axis of the exhaust port unambiguously due to an asymmetrical shape thereof.

In various embodiments, the gas injector is configured to supply an essentially inert gas to the tubing at a flow rate of between 4 and 400 L/min.

In further embodiments, the exhaust system is configured to create a pressure differential between the ionization chamber and a point downstream of the exhaust port so that the residual fluid is aspirated through the exhaust port and into the tubing at flow rates of about 4 to 400 L/min. In certain embodiments, the flow rate of the injected gas and the flow rate of a general residual fluid extraction essentially equal each other.

In various embodiments, the gas injector has the shape of a nozzle, preferably with a tapering nozzle tip. In some embodiments, the nozzle may be of the de-Laval type and can inject a supersonic jet of gas into the tubing.

It may prove advantageous to widen again the cross section of the tubing at a point downstream of the cross section transition in order to obtain a diffusing effect for the fluids flowing there-through.

Between the ionization chamber and the gas injector, the tubing may have the shape of a truncated cylinder which is particularly space-saving and allows more space to be assigned to other components of an analytical system, for example in an instrument housing where total space is limited.

The ion source preferably is configured to be used with one of electrospray ionization, chemical ionization, and photo-ionization as mentioned in the introduction.

In a second aspect, the invention pertains to a method for operating an exhaust system for an atmospheric pressure ion source, comprising the steps of (i) providing an ionization chamber with an exhaust port and a tubing coupled to the exhaust port, (ii) providing a transition from a first cross section of the tubing to a second cross section of the tubing at a point downstream of the exhaust port, wherein the second cross section is reduced in relation to the first cross section, and (iii) injecting a gas into the tubing in a region of the transition to transfer momentum from the gas to surrounding fluid for extracting residual fluid from the ionization chamber through the exhaust port and into the tubing.

In various embodiments, the gas is injected at flow rates of between 4 and 400 L/min.

In further embodiments, the exhaust system is operated such that residual fluid is aspirated through the exhaust port and into the tubing at flow rates of about 4 to 400 L/min.

In certain embodiments, the flow rate of the injected gas and the flow rate of the general residual fluid extraction essentially equal each other.

Preferably, the injected gas is an essentially inert gas, such as molecular nitrogen or air.

In a third aspect the invention relates to an atmospheric pressure ion source, comprising a spray probe for spraying a liquid into an ionization chamber, the ionization chamber having an exhaust port through which a residual fluid is extracted, and an exhaust system comprising a tubing which is connected to the exhaust port and to a vacuum source, wherein the vacuum source has the configuration of a gas jet pump.

BRIEF DESCRIPTION OF THE DRAWINGS

The invention can be better understood by referring to the following figures. The elements in the figures are not necessarily to scale, emphasis instead being placed upon illustrating the principles of the invention (often schematically). In the figures, like reference numerals generally designate corresponding parts throughout the different views.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
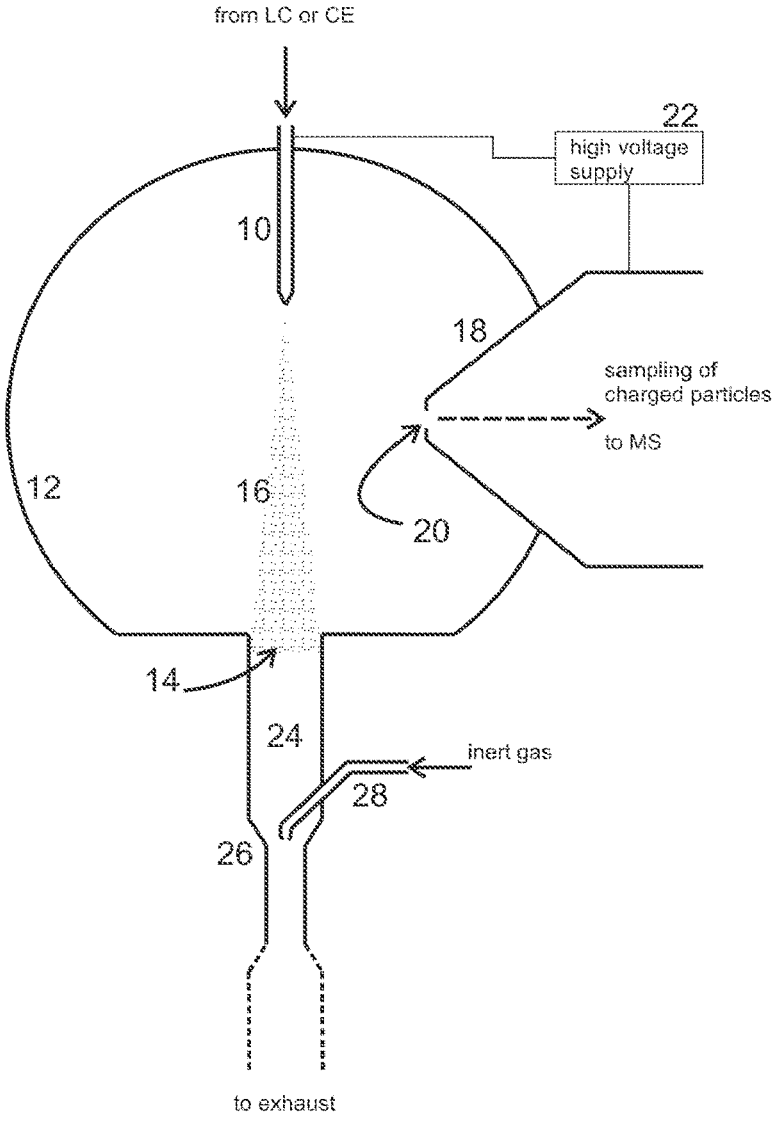
FIG. 1 illustrates an implementation of an atmospheric pressure ESI source according to principles of the invention in a schematic cross sectional view.

FIG. 1 shows a spray probe 10 reaching into an ionization chamber 12. The spray probe 10 may receive the eluent from an LC, for example. Exhaust port 14 is located at the opposite side of the ionization chamber 12 as to receive a spray cone 16 emanating from the spray probe 10. Preferably, the exhaust port 14 is configured such as to receive the complete spray cone 16 in order to avoid any back bouncing of droplets from the rim of the exhaust port 14 into the upstream portion of the ionization chamber 12. The exhaust system comprises a specific vacuum source to be described in detail further below, which is integrated into the general ion source assembly such that it generates a pressure differential between the ionization chamber 12 and a point downstream of the exhaust port 14. Thereby, a flow of waste gas (for example evaporated solvent) and residual spray mist (such as unevaporated droplets) from the ionization chamber 12 through the exhaust port 14 can be created. The special vacuum source may be assisted by additional operation of other vacuum sources, such as Venturi pumps or rotary pumps (not shown).

Entrance cone 18 with entrance aperture 20 is arranged laterally to the spray probe 10 and represents an interface to a vacuum stage of a mass spectrometer (not illustrated), through which charged particles, such as gas-phase ions and/or tiny charged droplets, can be sampled from the ionization chamber 12. The interface however shall not be restricted by the design depicted. Other possible designs may encompass a simple sampling orifice in the ionization chamber wall, or the front end of a tubular transfer capillary, for instance. In the present implementation the spray probe 10 and the entrance cone 18 are connected to a high voltage supply 22 in order that a high voltage difference can be generated between the spray probe tip and the entrance aperture 20 for proper electrospray operation. In the present illustration the (electro-)spray probe 10 is shown as a simple capillary. It is, however, understood that such a simple sketchy representation shall also include more elaborate (electro-)spray probes as known from the art, such as comprising conduits for nebulizer and/or desolvation gases.

The exhaust port 14 is connected to an exhaust tube 24 which initially has a cross section that generally matches the cross section of the exhaust port 14 and thereby allows smooth transition for waste gas and spray mist exiting the chamber 12 and entering the tube 24. However, it can also have a slightly larger cross section below the exhaust port 14 in order to allow for some waste gas expansion, arising for example from additional evaporation of spray mist droplets. The exhaust tube 24 can generally be made from one piece or can be composed of several separate components joined together. At a point downstream of the exhaust port 14 the cross section (or inner width) of the straight tube 24 narrows down in a transition region 26. In this case, the transition comprises a linear tapering of the corresponding tube wall. A non-linear tapering, such as a convex or concave tapering, is also implementable, however.

In the region of transition 26 from the initial large cross section to the reduced cross section, an angled, nozzle-shaped gas injector 28 is located and configured such as to inject a gas in a downstream direction. In the present illustration the gas injector 28 is shown to inject the gas substantially on-axis, and parallel to the axis, of the exhaust tube 24. However, such design is not compulsory. It may be possible to deviate from a co-axial injection pattern without deteriorating the beneficial effects of the gas injection. The injected gas preferably is an essentially inert gas, such as molecular nitrogen or air.

The injection of gas in a region of cross section transition 26 entails a momentum transfer from the injected gas to the surrounding fluid, during operation it may comprise spray mist as well as waste gas, and thereby generates suction forces on the fluids to deliver them to an exhaust collection or processing device (not shown) further downstream. By virtue of the special design of the gas injector and its surroundings, back flash which would lead to recirculation of waste gas and spray mist in the ionization chamber 12 can be impeded even more than with prior art vacuum sources. Hence, the analysis of the sprayed analytes is less disturbed leaving this kind of operation more robust than those previously known.

The tip of the gas injector 26 is shown presently to lie within the tapering portion of the exhaust tube 24. However, the injector tip, or the portion of the injector from which the gas is ejected, may also be located a little upstream or downstream of the tapering portion in order to achieve the desired effect. Optionally, at a point downstream of the transition 26, the cross section of the transition may widen again (shown with dashed contour) in order to provide a diffuser effect which generally assists in setting appropriate pressure conditions in this portion of the tubing.

Figure 2:
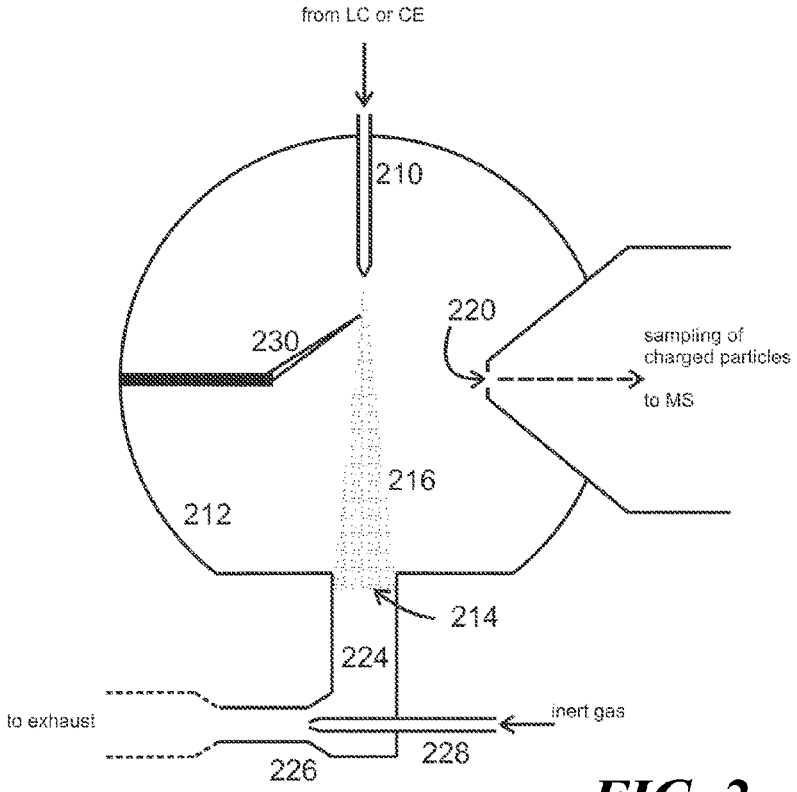
FIG. 2 illustrates an implementation of an APCI source according to principles of the invention in a schematic cross sectional view.

FIG. 2 shows an ion source and exhaust system assembly similar to the one illustrated in the previous figure. Therefore, the following description will focus on the differences between the implementations.

In the present implementation, a corona discharge needle 230 is shown to extend into a region of the spray cone 216 emanating from the spray probe 210, preferably at a point upstream of the entrance aperture 220. As is generally known from APCI operation, the corona discharge needle 230 generates a plasma in order to ionize molecules of a reagent ion source gas, as a result of which the molecules thusly ionized can then react with actual analyte molecules which are present in the spray cone 216, primarily via charge transfer reactions. A mechanism for introducing the reagent ion source gas is conventional and is not shown in the illustration for clarity. The reagent ion source gas can be added to a nebulizer gas used to generate the spray cone 216, for instance.

In this example, the exhaust tube 224 connected to the exhaust port 214 at the ionization chamber 212 has an angled design wherein a direction of flow of the waste gas and spray mist turns about 90°. Immediately after the turn, the transition region 226 from a larger cross section to a reduced cross section of the exhaust tube 224 is located. Further, a straight, nozzle-shaped gas injector 228 is arranged within the transition region 226, which injects a gas into a downstream direction of the exhaust tube 224. Optionally, as described in conjunction with another exemplary embodiment, the cross section of the tubing may widen again (shown with dashed contour) in order to render a diffusing effect on the fluids flowing there-through.

By virtue of the injection of gas in a region of cross section transition 226, momentum transfer occurs, which generates suction forces on waste gas and spray mist in order to extract them from the ionization chamber 212 and deliver them to an exhaust collection or processing device further downstream. The local pressure conditions resulting from the injection of the gas facilitate following the turn of the exhaust tube 224 at the bend for the spray mist and waste gas particles so that a risk of gas or droplet back bouncing from the tube wall at the position of the bend is reduced. In this manner, back flash effects which would lead to recirculation of waste gas and spray mist in the ionization chamber 212 can be efficiently impeded, if not prevented completely.

Figure 3:
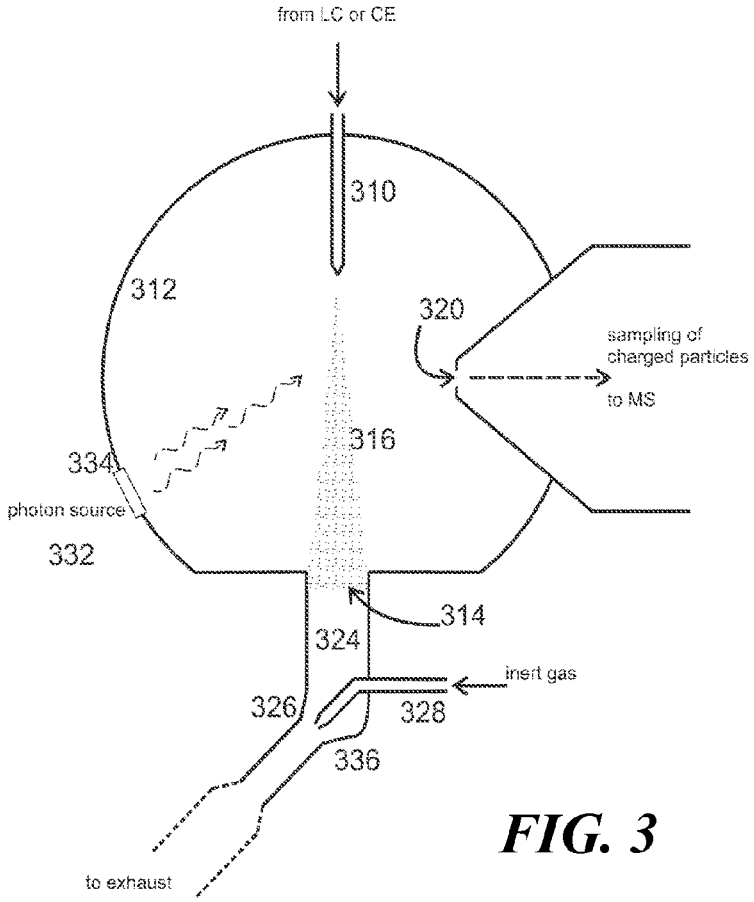
FIG. 3 illustrates an implementation of an APPI source according to principles of the invention in a schematic cross sectional view.

FIG. 3 shows an ion source and exhaust system assembly similar to the ones illustrated in the previous figures. Therefore, the following description will focus on the differences between the implementations.

In the present implementation, a photon source 332, such as a laser or UV lamp, is located at the periphery of the ionization chamber 312 for executing photo-ionization. The ionization chamber wall has a window 334 transparent for the photons emitted from the photon source 332, which is arranged and configured such that the photons may intersect the spray cone 316 emanating from the spray probe 310, preferably at a point upstream of the entrance aperture 320, so that upon hitting the spray cone 316 the photons may ionize the analyte molecules contained therein. At a side opposite to the window 334 and along the direction of propagation of the photons, a beam dump (not shown) may be located at the ionization chamber periphery in order to reduce the presence of stray photons.

Also in this example, the exhaust tube 324 connected to the exhaust port 314 at the ionization chamber 312 has an angled design wherein a direction of flow of the waste gas and spray mist turns about 45° from an original direction of flow. In other words, an angle between the two tube segments adjoining the bend is about 135°. In the region of the turn, the transition 326 from a larger cross section to a reduced cross section of the exhaust tube is located. Further, an angled, nozzle-shaped gas injector 328 is arranged within the transition region 326, which injects a gas into a downstream direction of the exhaust tube 324 as has been described in conjunction with previous figures. Optionally, likewise as described in conjunction with another exemplary embodiment, the cross section of the tubing may widen again (shown with dashed contour) in order to render a diffusing effect on the fluids flowing there-through.

By virtue of the injection of gas in a region of cross section transition 326, momentum transfer occurs, which generates suction forces on waste gas and spray mist in order to extract them from the ionization chamber 312 and deliver them to an exhaust collection or processing device further downstream. The local pressure conditions resulting from the injection of the gas facilitate following the turn of the exhaust tube 324 at the bend for the spray mist and waste gas particles so that a risk of gas or droplet back bouncing from the tube wall at the position of the bend is reduced. In this manner, back flash effects which would lead to recirculation of waste gas and spray mist in the ionization chamber 312 can be efficiently impeded. Smooth flow conditions of the waste gas and spray mist can be further improved by providing rounded bends in the tubing wall as shown in FIG. 3 at 336.

Figure 4:
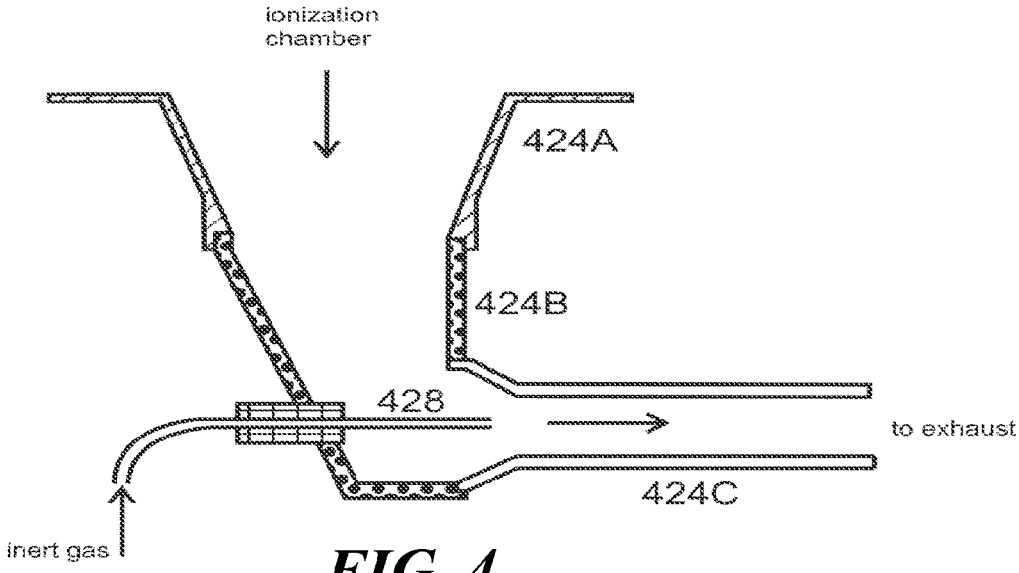
FIG. 4 illustrates an implementation of an exhaust system according to principles of the invention with different tubing.

FIG. 4 shows an embodiment of an exhaust system according to principles of the present invention in schematic cross section representation in more detail. The exhaust system has a first tubing segment 424A comprising a flange which assists in attaching it to an ionization chamber (not shown). The inner width of the first tubing segment 424A has a slight taper and allows efficient channeling down of residual spray droplets and waste gas from the ionization chamber. The aperture between the flange extensions may serve as exhaust port. A second tubing segment 424B is (gas-tightly) attached downstream of the ionization chamber to the first tubing segment 424A. In the present embodiment, the right wall (in cross section view) extends straight down whereas the left wall is inclined thereto, likewise forming a tapering inner width of the second tubing segment 424B. The second tubing segment 424B stops at a bend about 90° to the right. At this point, a third tubing segment 424C is laterally (gas-tightly) attached to the second tubing segment 424B and continues the exhaust line. At a proximal portion, that is, close to the attach point, the third tubing segment 424C comprises a transition from a large inner width to a smaller inner width. An injector capillary 428 extends from a (sealed) through-hole at the inclined wall of the second tubing segment 424B to the region of cross section transition. By injecting a preferably inert, gas downstream into the third tubing segment 424C, suction forces can be generated which extract residual fluid from the ionization chamber through the exhaust port and into the tubing 424 to exhaust as has been described previously.

Some implementations according to principles of the invention were subjected to test runs with a dye. The dye of bluish color, alternately with a sample of synthetic urine (Surine) spiked with Alprazolam as analyte to be detected by the mass spectrometer, was added in quantities of about 5 mL to a solvent and fed into the spray probe. The ion source used in the test runs was configured for electrospray ionization and had an exhaust system design as schematically illustrated in FIG. 4. Test runs with gas injection through the gas injector at flow rates of about 40-50 L/min were compared with test runs where waste gas was extracted by means of a Venturi pump (no injector present in the tubing).

Visual inspection of the entrance cone revealed that bluish deposits covered almost the whole cone surface area facing the ionization volume, and were also found on other inner chamber surfaces, when the vacuum source did not operate with gas injection, thereby indicating rather bad waste extraction conditions and significant recirculation of waste gas and excess spray mist. Apparently, as an immediate result of this, signal recovery of the Alprazolam in the mass spectrometer was considerably reduced, such as down to 62% compared to the amount originally spiked. Without being bound by any particular theory, this finding is attributed (i) to the fact that the dye deposits on surfaces in the ionization chamber, such as on the entrance cone, entail a build-up of electrostatic charge which distorts the electric field configuration close to the entrance aperture that is generally crucial in electrospray ionization for efficient sampling, and (ii) to clogging of the entrance aperture resulting in a reduced geometrical acceptance thereof for charged particles, such as ions and tiny charged droplets.

When the vacuum source worked with gas injection in the transition region of the tubing, visual inspection revealed significantly less bluish deposits on chamber surfaces as well as an Alprazolam signal recovery increased to values of up to 98%, an improvement of about a third compared with the previously described test runs. A fair conclusion from these results is that the operation of the gas injector in the exhaust tube as vacuum source reduces the extent of back flash and waste recirculation in the ionization chamber, thereby lowering the extent of electric field distortion and clogging, so that the analysis is rendered more reliable and robust.

Figure 5:
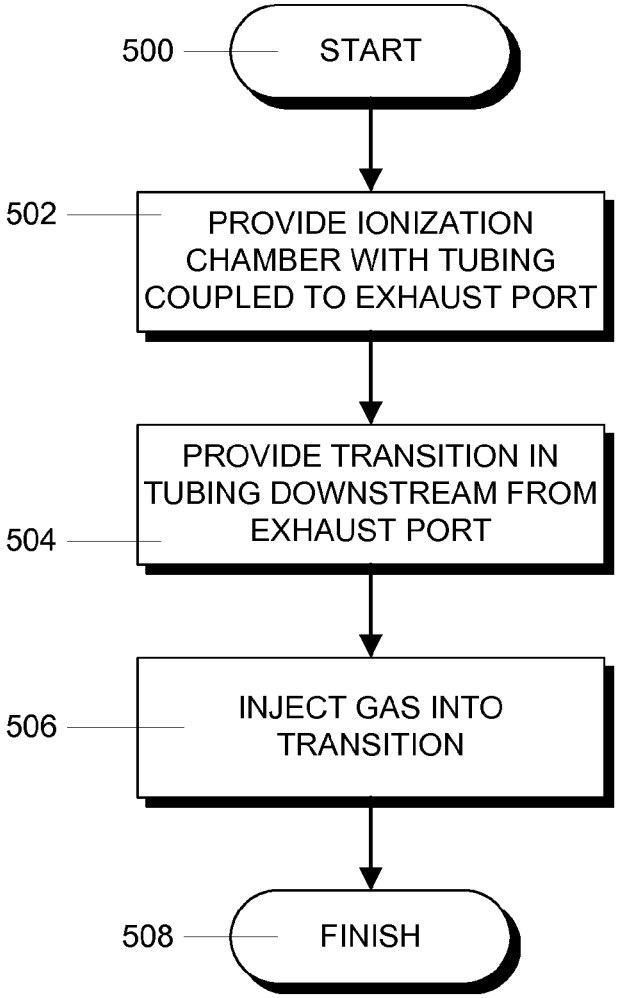
FIG. 5 is a flowchart that illustrates the steps in an illustrative method for operating an atmospheric pressure ion source.

FIG. 5 is a flowchart that shows the steps in an illustrative method in accordance with the principles of the invention. This method begins in step 500 and proceeds to step 502 where an ionization chamber is provided with an exhaust port and a tubing coupled to the exhaust port. Next, in step 504, a transition from a first cross section of the tubing to a second cross section of the tubing at a point downstream of the exhaust port is provided, wherein the second cross section is reduced in relation to the first cross section. Then, in step 506, a gas is injected into the tubing in a region of the transition to transfer momentum from the gas to surrounding fluid for extracting residual fluid from the ionization chamber through the exhaust port and into the tubing. The method then finishes in step 508.

The afore-described innovation proves particularly advantageous for MS analysis of an LC eluent, although not being restricted thereto. Other conceivable liquid inputs to the spray probe may include eluents of capillary electrophoresis (CE), to name another example. Such eluents basically comprise a flow of liquid solvent in which a plurality of analyte molecule peaks or ion peaks is distributed according to the effect of the separation mechanism of the liquid chromatography, capillary electrophoresis, or whichever is applied. This means that periods in which an analyte molecule peak or ion peak is eluted together with the solvent into the ion source alternate with periods in which no analyte molecule peak or ion peak is eluted, that is, where the eluent is solely comprised of liquid carrier medium or solvent. These latter "blank" periods can contribute significantly to contamination of the ionization chamber without offering any utility in terms of molecule analysis. In other words, the present invention helps overcoming the problems caused by contamination due to solvent recirculation, and in particular allows unimpaired continuous operation of an LC/CE-MS largely without contamination problems.

In the above-illustrated embodiments, the axis of the spray probe and the axis of the exhaust port are shown to be largely coincidental. This, however, is not necessary. The exhaust port can be aligned differently in relation to the spray probe as long as major parts of the spray cone, if not the whole spray cone, are received therein. In fact, the exhaust port may be configured such that it is not possible to define an axis at all. The illustrations also depict perpendicular arrangements of spray direction and sampling direction of charged particles, such as ions and/or tiny charged droplets. However, the invention is not intended to be restricted in this regard. Rather, other angled designs are also conceivable.

The expression tubing used within this disclosure is not to be understood restrictive. Tubing does not necessarily have to consist of tubes but can also be embodied by any type of conduit or line capable of transmitting residual fluid from the ionization chamber to exhaust.

Furthermore, the ionization chamber 12, 212, 312 is shown to largely have a circular cross section. This is also not to be interpreted restrictive. Although a general round configuration of the ionization chamber 12, 212, 312 may promote favorable flow conditions in the chamber, other "un-round" designs, such as cube or cuboid designs of the chamber, can also facilitate reducing the recirculation.

It will be understood that various aspects or details of the invention may be changed, or various aspects or details of different embodiments may be arbitrarily combined, if practicable, without departing from the scope of the invention. For example, it is possible to combine an electrospray probe as shown in FIG. 1 with the exhaust system designs of FIGS. 2 and 3. Likewise can the APCI source design of FIG. 2 be combined with the exhaust system designs of FIGS. 1 and 3. It is equally possible to combine the APPI source design of FIG. 3 with the exhaust system configurations of FIGS. 1 and 2. Finally, it goes without saying that the exhaust system of FIG. 4 is compatible with the ionization chambers and ion sources depicted in any one of the FIGS. 1 to 3. Generally, the foregoing description is for the purpose of illustration only, and not for the purpose of limiting the invention which is defined solely by the appended claims.

What is claimed is:

1. An atmospheric pressure ion source, comprising:

a spray probe for spraying a liquid into an ionization chamber, the ionization chamber having an exhaust port through which a residual fluid is extracted;

an exhaust system comprising a tubing which is connected to the exhaust port, the tubing having a transition from a first cross-section to a second cross section at a point downstream of the exhaust port, the second cross section being reduced in relation to the first cross section; and a gas injector a tip of which is located in the tubing and through which a gas can be injected into the tubing in a region of the transition.

2. The atmospheric pressure ion source of claim 1, wherein the tubing comprises a bend, and the transition is located downstream of, and proximate to, the bend.

3. The atmospheric pressure ion source of claim 2, wherein the tubing has rounded walls in the region of the bend.

4. The atmospheric pressure ion source of claim 2, wherein the tubing has a first segment upstream of the bend and a second segment downstream of the bend, and an angle between the first segment and the second segment ranges from 90° to 180°.

5. The atmospheric pressure ion source of claim 1, wherein the exhaust port is located and configured in order to receive a spray cone emanating from the spray probe.

6. The atmospheric pressure ion source of claim 1, wherein an axis of the exhaust port and an axis of the tubing coincide with an axis of the spray probe so that a spray cone emanating from the spray probe is substantially centered on the joint axis.

7. The atmospheric pressure ion source of claim 1, wherein the gas injector is configured to supply an inert gas to the tubing at a flow rate of between 4 and 400 L/min.

8. The atmospheric pressure ion source of claim 1, wherein the exhaust system is configured to create a pressure differential between the ionization chamber and a point downstream of the exhaust port so that the residual fluid is aspirated through the exhaust port and into the tubing at flow rates of substantially 4 to 400 L/min.

9. The atmospheric pressure ion source of claim 1, wherein the gas injector has the shape of a nozzle.

10. The atmospheric pressure ion source of claim 1, wherein, at a point downstream of the cross section transition, the cross section of the tubing widens again as to obtain a diffusing effect for the fluids flowing there-through.

11. The atmospheric pressure ion source of claim 1, wherein, between the ionization chamber and the gas injector, the tubing has the shape of a truncated cylinder.

12. The atmospheric pressure ion source of claim 1, wherein ionization is performed by one of electrospray ionization, chemical ionization, and photo-ionization.

13. A method for operating an exhaust system for an atmospheric pressure ion source, comprising:

(a) providing an ionization chamber with an exhaust port and a tubing coupled to the exhaust port;

(b) providing a transition from a first cross section of the tubing to a second cross section of the tubing at a point downstream of the exhaust port, wherein the second cross section is reduced in relation to the first cross section; and (c) injecting a gas into the tubing in a region of the transition, by operating a gas injector a tip of which is located in the tubing, to transfer momentum from the gas to surrounding fluid for extracting residual fluid from the ionization chamber through the exhaust port and into the tubing.

14. The method of claim 13, wherein in step (c), the gas is injected at flow rates of between 4 and 400 L/min.

15. The method of claim 13, wherein the exhaust system is operated such that residual fluid is aspirated through the exhaust port and into the tubing at flow rates of about 4 to 400 L/min.

16. The method of claim 13, wherein a flow rate of the injected gas and a flow rate of the general residual fluid extraction essentially equal each other.

17. The method of claim 13, wherein the injected gas is an inert gas.

18. The method of claim 17, wherein the inert gas is one of molecular nitrogen and air.

19. An atmospheric pressure ion source, comprising:

a spray probe for spraying a liquid into an ionization chamber, the ionization chamber having an exhaust port through which a residual fluid is extracted; and an exhaust system comprising a tubing which is connected to the exhaust port and to a vacuum source, wherein the vacuum source is a gas jet pump an injector tip of which is located in the tubing.

* * * * *